US006055400A

United States Patent [19]

Emukai et al.

[11] Patent Number: 6,055,400

[45] Date of Patent: Apr. 25, 2000

[54] MULTICOLOR IMAGE FORMING APPARATUS

[75] Inventors: Tetsurou Emukai; Akihiro Yamashita, both of Saitama, Japan

[73] Assignee: Fuji Xerox Co., Ltd., Tokyo, Japan

[21] Appl. No.: 09/126,103

[22] Filed: Jul. 30, 1998

[30] Foreign Application Priority Data

Jul. 31, 1997 [JP] Japan ..... 9-218977

[51] Int. Cl.[7] ..... G03G 15/01; G03G 15/04; G03G 15/043

[52] U.S. Cl. ..... 399/226; 399/51; 399/177

[58] Field of Search ..... 399/40, 51, 54, 399/226, 227, 231, 302

[56] References Cited

U.S. PATENT DOCUMENTS 5,835,825 11/1998 Maruta ..... 399/227

FOREIGN PATENT DOCUMENTS 5-188829 7/1993 Japan .

*Primary Examiner*—Matthew S. Smith
*Assistant Examiner*—Hoang Ngo
*Attorney, Agent, or Firm*—Finnegan, Henderson, Farabow, Garrett & Dunner, L.L.P.

[57] ABSTRACT

In a multicolor image forming apparatus, in order to form two pages of toner images on a transfer belt, a plurality of images are written during a first interimage period. After writing of the plurality of images, a development unit is rotated during a subsequent second interimage period to prepare for the subsequent toner color. The second interimage period is predetermined longer than the first interimage period. The second interimage is predetermined including the time required until the development of the images thus written is terminated, the time required for the rotation of the development unit and the time required for convergence of vibration caused accompanying the rotation.

8 Claims, 7 Drawing Sheets

MULTICOLOR IMAGE FORMING APPARATUS

BACKGROUND OF THE INVENTION

1. Field of the Invention

The present invention relates to a multicolor image forming apparatus. More particularly, the present invention relates to a multicolor image forming apparatus suitable for the prevention of streak-like image defect caused by vibration accompanying the operation of a development unit.

2. Description of the Related Art

In a multicolor image forming apparatus, Y (yellow), M (magenta), C (cyan) and K (black) toner images are formed on a first image carrier. These color toner images are primarily transferred onto a second image carrier so that they are superimposed on each other to form a multicolor toner image. The multicolor toner image thus formed is then secondarily transferred onto a printing medium such as paper and plastic film sheet to obtain a desired multicolor image. The foregoing monochromatic toner images are each obtained by irradiating the first image carrier with laser beam modified according to image data to form an electrostatic latent image, which is then developed by a development unit for each color. The development unit is provided for each color. These development units are sequentially arranged opposed to the first image carrier to effect development. As an example of a development device, there is known a rotary development device.

In a rotary development device, respective color development units are equally disposed on the circumference of the rotary device. These color development units are rotated by an angle of 90 degrees and positioned corresponding to the development timing of the respective colors to effect development. During development, a development roll to which a toner has been attached is arranged opposed to the first image carrier at a predetermined gap. An apparatus is known which is arranged to allow a tracking roll as a gap holding means to come in contact with the surface of the first image carrier to keep the gap between the development roll and the first image carrier constant.

An apparatus can be proposed which is arranged to keep the gap between the development roll and the first image carrier at a proper value by allowing the tracking roll to come in contact with a separate member properly positioned relative to the first image carrier rather than allowing the tracking roll to come in contact with the first image carrier. As an example of an image forming apparatus there is disclosed one including a rotary development device in Japanese Patent Unexamined Publication No. Hei. 5-188829.

The foregoing conventional image forming apparatus has the following problems. Firstly, the image forming apparatus which allows the tracking roll to come in direct contact with the first image carrier is disadvantageous in that when the development roll is rotated during positioning, an impact vibration is transmitted to the first image carrier. If the first image carrier is irradiated with laser beam for the subsequent image formation while the development roll is being positioned, the foregoing impact causes electrostatic latent images to be shifted, generating band-like streaks (banding) or other image defects.

The image forming apparatus which allows the tracking roll to come in contact with the member other than the first image carrier is not liable to the transmission of impact to the first image carrier. However, since this mechanism involves indirect positioning, it is not necessarily easy to keep the gap between the development roll and the first image carrier accurate. In other words, this mechanism is disadvantageous in that the provision of the member other than the first image carrier adds to the number of parts required. This mechanism is also disadvantageous in that the accurate adjustment of the position of the member other than the first image carrier and the image carrier relative to each other requires an increased number of assembling steps.

SUMMARY OF THE INVENTION

The present invention gives solution to the foregoing problems. An object of the present invention is to provide a multicolor image forming apparatus which is not liable to deterioration of image quality due to impact caused during the positioning of the development roll even when the tracking roll is allowed to come in direct contact with the first image carrier.

In order to achieve the forgoing object, the present invention provides a multicolor image forming apparatus which transfers a plurality of monochromatic toner images formed on a first image carrier onto a second image carrier in a superimposed manner to form a multicolor toner image, and then transfers the multicolor toner image onto a printing medium, comprising: exposure means for writing an image based on image data onto the first image carrier; development means having a plurality of development units provided for each toner color for developing the image written on the first image carrier; development unit movement means for moving one for a color to be used subsequently among the plurality of development units to a development position; and writing processing means for initiating the writing of an image corresponding to the subsequent toner color by the exposure means after the passage of a first predetermined time required to complete the movement of the preceding development unit by the development unit movement means following the termination of the writing of an image corresponding to the preceding toner color.

DETAILED DESCRIPTION OF THE PREFERRED EMBODIMENTS

Embodiments of the present invention will be described in detail in connection with the accompanying drawings. FIG.

Figure 2:
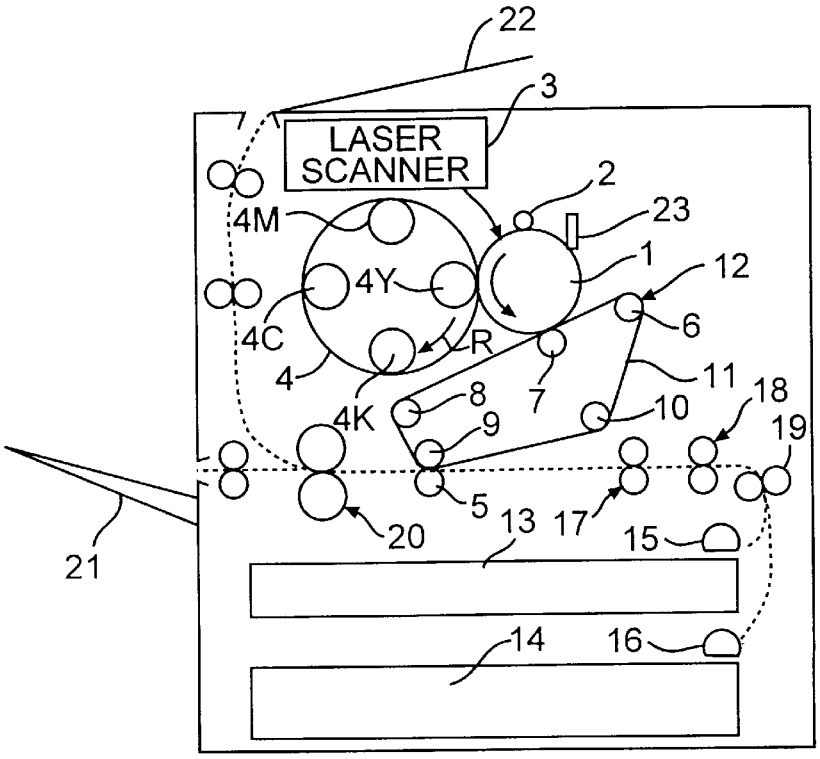
FIG. 2 is a sectional view illustrating the image forming apparatus.

2 is a sectional view illustrating the outline of an embodiment of the multicolor image forming apparatus according to the present invention. In FIG. 2, disposed on the periphery of a drum-like photoreceptor 1 are parts for forming an electrophotographic image, including a charger 2, a laser scanner 3 as an exposure means, a development device 4 and a cleaner 23. The photoreceptor 1 is uniformly charged by the charger 2. Under these conditions, the photoreceptor 1 is irradiated with laser beam modified according to image data by the laser scanner 3 to form an electrostatic latent image thereon. The electrostatic latent image thus formed is then developed with a predetermined color toner by the development device 4.

The development device 4 includes development units 4Y, 4M, 4C and 4K for colors Y, M, C and K, respectively. Every time the development for each color is terminated, the development device 4 is rotated in the direction indicated by the arrow R by the action of a motor (not shown). In this manner, toner images are formed on the photoreceptor 1 in the order of Y, M, C and K. A rotary force is transmitted to the development device 4 via a solenoid clutch (not shown) from the foregoing motor. When the motor is turned on, the solenoid clutch is disengaged to enable the rotation of the development device 4. When the motor is turned off, the solenoid clutch is engaged to regulate the rotation of the development device 4.

The respective color toner images may be each formed one by one. However, a plurality of sheets of a toner image of the same color may be continuously formed depending on the image size. For example, if two pages of a toner image of the same color are formed, development is effected over two pages, followed by the rotation of the development device 4 for the subsequent development of other colors. The development units 4Y, 4M, 4C and 4K are each provided with a toner agitation roll, a conveyor roll, a development roll (all not shown), etc. Among these rolls, the development roll coaxially includes a tracking roll as a gap holding means which comes in contact with the photoreceptor 1. The tracking roll allows the gap between the development roll and the photoreceptor 1 to be kept constant. The tracking roll is a ring-shaped member having a radius greater than that of the development roll by the gap. It is rotatably attached to both sides of the development roll.

Figure 9:
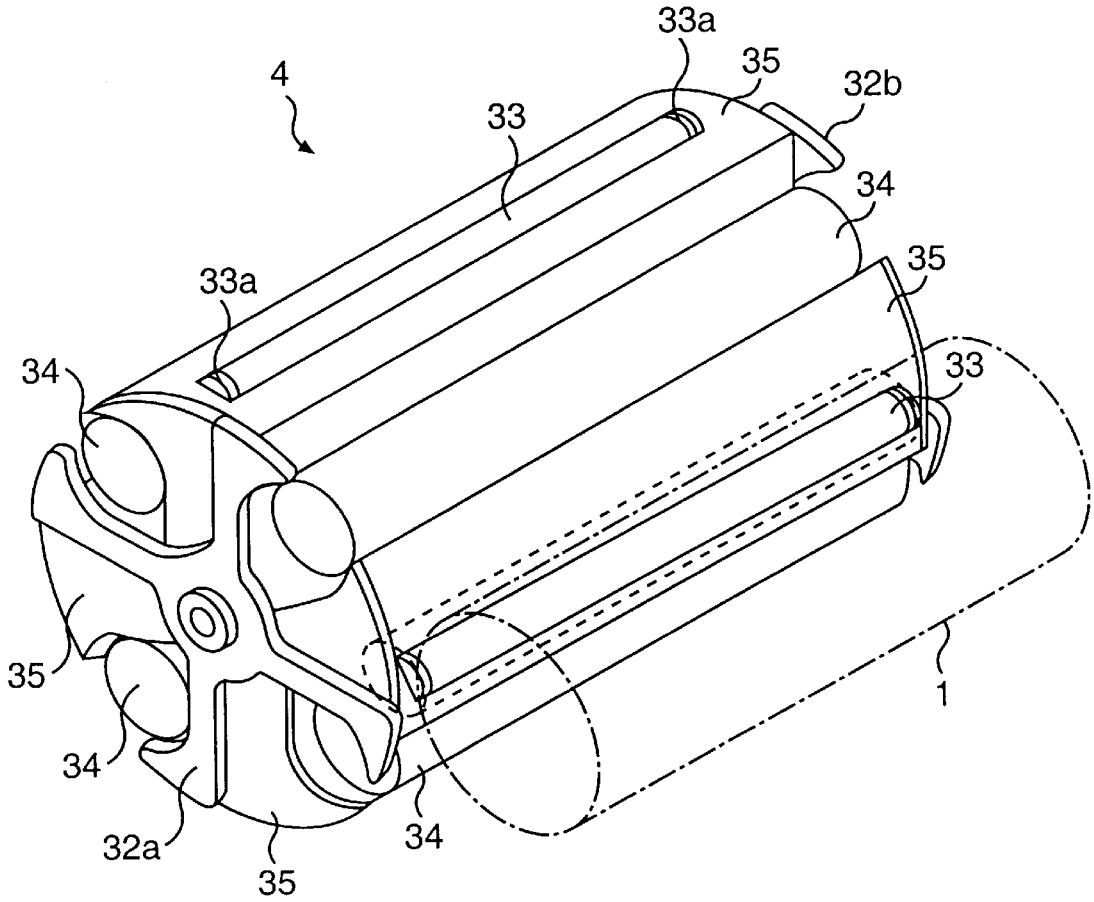
FIG. 9 is a perspective view illustrating the configuration of a development unit.

The foregoing development device 4 will be further described hereinafter. FIG. 9 is a perspective view illustrating the configuration of the development device 4. In FIG. 9, the rotary frame constituting the development device 4 includes a cross-assembled main frame (not shown) and side frames 32*a* and 32*b* provided on both sides of the main frame and is partitioned off into four zones corresponding to the four color development units. The development device 4 is rotated by a stepping motor (not shown) at every development of color toner. The foregoing four zones are each provided with a development unit having a development roll 33, a toner cartridge 34, etc. housed in a housing 35.

Housed in the toner cartridge 34 is a dual-component developer comprising a carrier and a toner which is supplied into the development roll 33 little by little. The amount of the dual-component developer to be supplied is controlled such that the proportion (concentration) of the toner in the developer can be properly maintained according to the consumption of the toner. The amount of the toner to be supplied is controlled by the driving speed of a conveyor means such as an auger (not shown) provided between the toner cartridge 34 and the development roll 33.

The four arm portions extruding from the side frames 32*a* and 32*b* and the housings 35 are engaged with each other in such an arrangement that they can move relative to each other in the longitudinal direction along the arm portions. The engagement and displacement of the side frames 32*a* and 32*b* and the housings 35 will be further described later in connection with FIG. 10. The development roll 33 is partially exposed from the housing 35. The exposed area of the development roll 33 is allowed to come in contact with the photoreceptor 1 via the tracking roll 33*a* to effect toner development.

Figure 10:
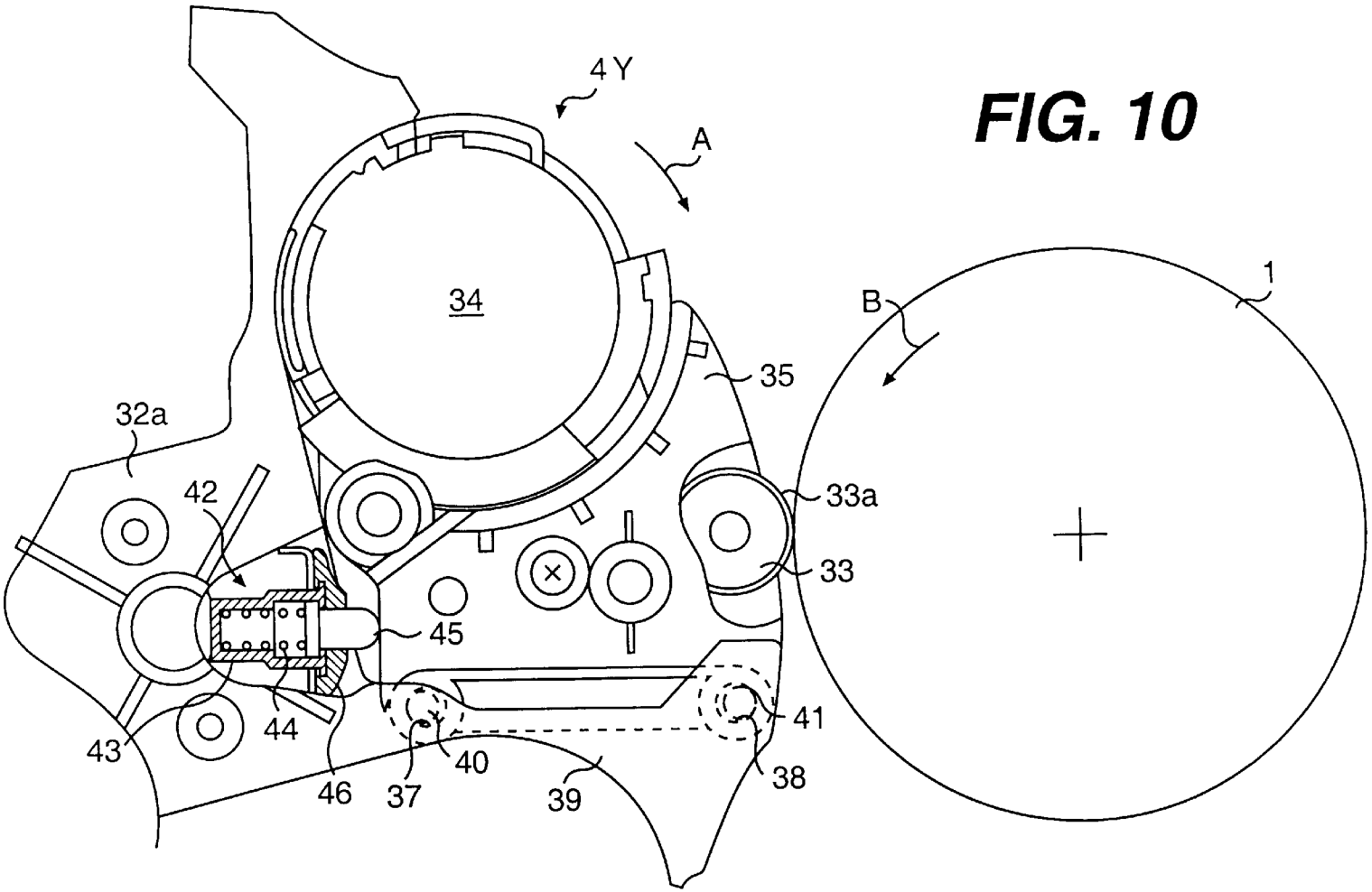
FIG. 10 is an enlarged view illustrating an essential part of the development unit.

FIG. 10 is an enlarged view of an essential part of the development device 4. In FIG. 10, the development roll 33 comes in contact with the photoreceptor 1 via the tracking roll 33*a*. Provided on the side face of the housing 35 of the development unit 4Y are long holes 37 and 38 in which pins 40 and 41 fixed to the arm portion 39 of the side frame 32*a* fit, respectively. Similar long holes and pins are provided also on the other side of the housing 35 and the side frame 32*b*. In other words, the housing 35 in which the development roll 33 is housed is supported by the side frame 32*a* and 32*b* via the pins 37 and 38.

Provided behind the housing 35 is a pressing device 42 which presses the housing 35 towards the photoreceptor 1. The pressing device 42 includes a casing 43 fixed to the main frame, a compression coil spring 44 housed in the casing 43 and a pressure pin 45 which is energized by the compression spring 44. The stroke of the pressure pin 45 is regulated by a lid 46 covering the casing 43 so that the pressure pin 45 cannot come off the casing 43. The tip of the pressure pin 45 is pressed against the rear portion of the housing 35 so that the housing 35 is pressed forward by the elastic force of the compression coil spring 44.

Provided adjacent to the photoreceptor 1 is an intermediate transfer device 12 including a plurality of rolls 6, 7, 8, 9 and 10 and a transfer belt 11 stretched between these rolls as an intermediate transfer body. The primary transfer roll 7 is pressed against the photoreceptor 1 with the transfer belt 11 provided interposed therebetween. The transfer belt 11 is charged at the polarity opposite that of the toner so that the toner image on the photoreceptor 1 is primarily transferred onto the transfer belt 11.

On the other hand, a secondary transfer roll 5 is provided opposed to the roll 9 with the transfer belt 11 provided interposed therebetween. In this arrangement, the toner image on the transfer belt 11 is transferred onto a sheet of recording paper which has been conveyed to the zone between the secondary transfer roll 5 and the roll 9, i.e., secondary transfer position. The sheets of recording paper are housed in stack in paper feed cassettes 13 and 14. The sheets of recording paper are withdrawn sequentially from the top of the stack by paper feed roll 15 or 16.

The sheet of recording paper thus withdrawn from the paper feed tray 13 or 14 is then fed to the secondary transfer position through a conveyance path (indicated by the dotted line) along which a pair of registration rolls 17, a pair of pre-registration rolls 18 and a pair of conveyor rolls 19 are provided. At the secondary transfer position, the toner image on the transfer belt 11 is then transferred onto the sheet of recording paper by the secondary transfer roll 5. The toner image which has been transferred onto the sheet of recording paper is then heat-fixed by a pair of fixing rolls 20. The sheet of recording paper is then discharged onto an outlet tray 21 or an upper outlet tray 22. The outlet tray 22 is a so-called face-down tray onto which the sheet of recording paper is discharged with its image side facing downward. The outlet tray 21 is a so-called face-up tray onto which the recording paper is discharged with its image side facing upward. The determination of which the tray is selected face-down or face-up is made by switching a gate (not shown) for switching the conveyance path provided downstream from the pair of fixing rolls 20.

Figure 3:
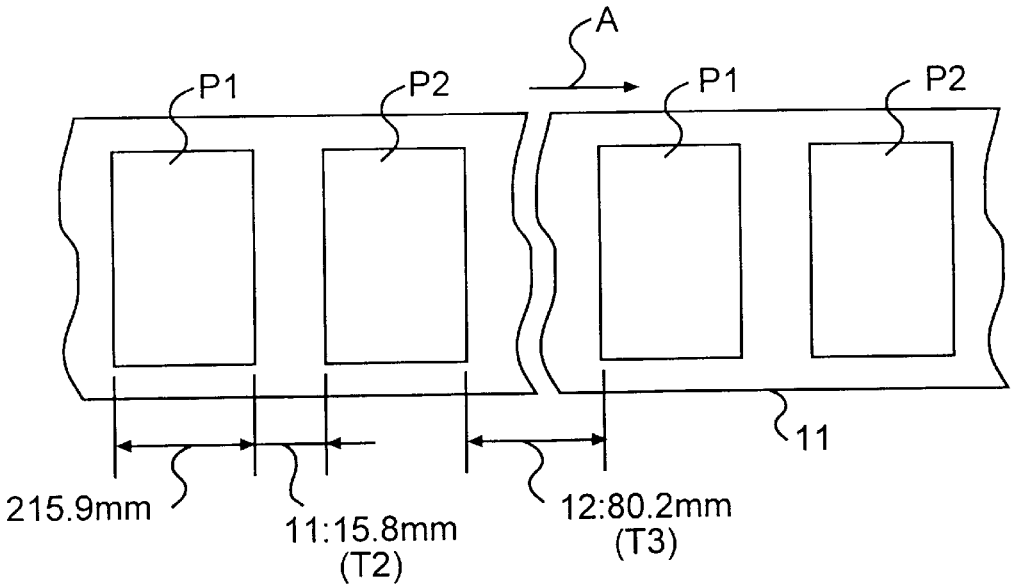
FIG. 3 is a diagram illustrating the positioning of toner images on a transfer belt.

The image forming operation of the image forming apparatus will be described hereinafter. Firstly, the operation will be described with reference to the case where two pages of toner images are formed on the transfer belt 11 at the same time. FIG. 3 is a diagram illustrating the positioning of toner images formed on the transfer belt 11. FIG. 3 shows toner images transferred onto the transfer belt 11 by two cycles. In the drawing, toner images P1 and P2 are of so-called letter size. These toner images are transferred such that the short side of the letter size coincides with the conveyance direction (arrow A) of the transfer belt 11. The toner images P1 and P2 are toner images of the same color transferred by one cycle.

For example, at the first cycle, toner images P1 and P2 of Y color are transferred. At the subsequent second cycle, a toner image of M color is superimposed on the toner images of Y color. Similarly, at the third cycle, a toner image of C color is transferred. At the fourth cycle, a toner image of K color is transferred. Once transferring is terminated until K color, the resulting multicolor toner image is secondarily transferred onto a sheet of recording paper.

The gap I1 between the two sheets of toner images P1 and P2 is the distance corresponding to the minimum time T2 required to carry the sheet of recording paper from the position of the pair of registration rolls 17 to the secondary transfer position and is 15.8 mm by way of example. The gap I2 required between the termination of transfer of the toner image P2 and the initiation of transfer of another toner image P1 of the subsequent color is the distance corresponding to the time T3 required to rotate and position the development device 4 for switching of toner color. It is greater than the foregoing gap I1 and is 80.2 mm by way of example. The size of the image along the direction of conveyance of the belt 11 is 215.9 mm for letter size.

Figure 1:
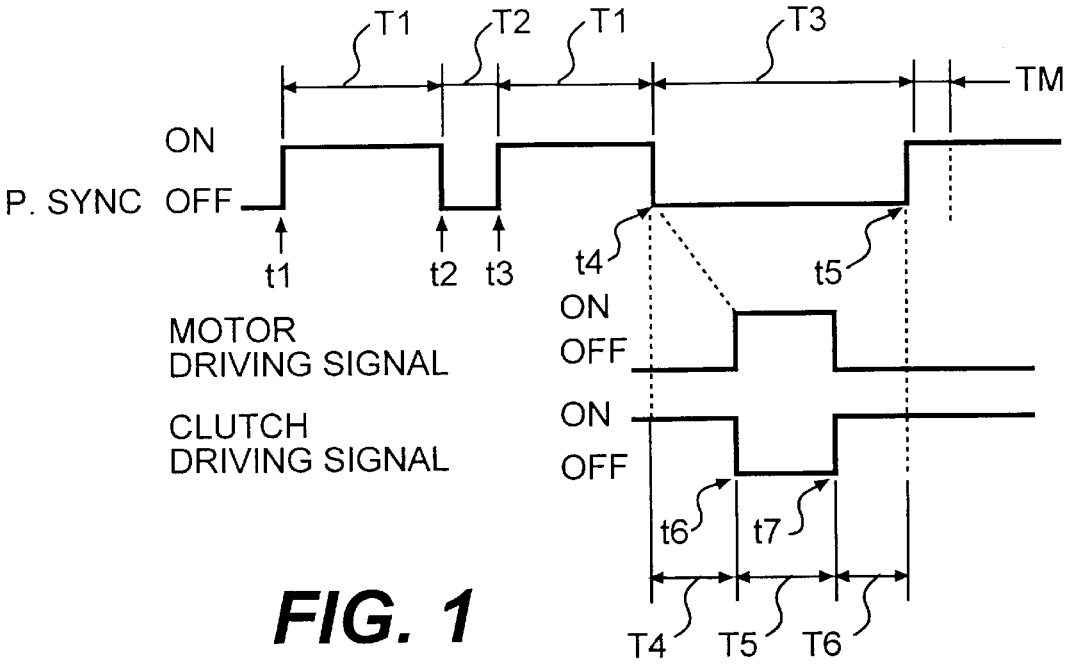
FIG. 1 is a timing chart illustrating the operation of an embodiment of the image forming apparatus according to the present invention.

The timing for forming an image will be described hereinafter. FIG. 1 is an operation timing chart illustrating the operation timing of page synchronization signal, development device motor driving signal and solenoid clutch driving signal. In this chart, the page synchronization signal P.SYNC for writing by the laser scanner 3 turns on at the timing t1, t3 to effect image writing for the first and second pages. At the timing t2, t4, the page synchronization signal P.SYNC turns off to terminate image writing for the first and second pages. The time T1 during which the page synchronization signal P.SYNC is on is 3,055 msec (corresponding to 215.9 mm as the moving distance of the belt) for letter size. The time T2 during which the page synchronization signal P.SYNC is off corresponds to the foregoing distance I1 and is 224 msec by way of example.

The time T3 between the timing t4 and the timing t5 at which image writing is initiated for the first page corresponds to the foregoing distance I2 and is 1,135 msec by way of example. The time T3 is predetermined on the following basis. Firstly, the time T4 between the termination of image writing at the timing t4 and the termination of development of the image is required. The time T4 is a time corresponding to the distance between the position at which image writing is made on the photoreceptor 1 by the laser scanner 3 and the position at which the image is developed. After the passage of the time T4, the development device motor driving signal is turned on at the timing t6 and the solenoid clutch is turned off. Under these conditions, the development device 4 is rotated by 90 degrees. In other words, at the timing t6, the development of the preceding image is terminated, and the development unit for the subsequent color toner image is rotated to move to the development position. When the rotation of the development device 4 is terminated at the timing t7, the development device motor driving signal is turned off and the solenoid clutch is turned on to fix the development device 4, thereby terminating positioning. The rotation and positioning of the development device requires time T5. Further, as the time between after the disengagement of the solenoid clutch by the rotation of the development device 4 and the decay vibration accompanying the operation (vibration convergence time) there is required time T6.

As the time T3 there is predetermined a time equal to the sum of at least times T4, T5 and T6. The times T4, T5 and T6 are predetermined to 612 msec, 259 msec and 265 msec, respectively, by way of example. As the margin TM between the point at which the page synchronization signal P.SYNC rises and the point at which an image is actually written there may be secured 43 msec by way of example.

Figure 4:
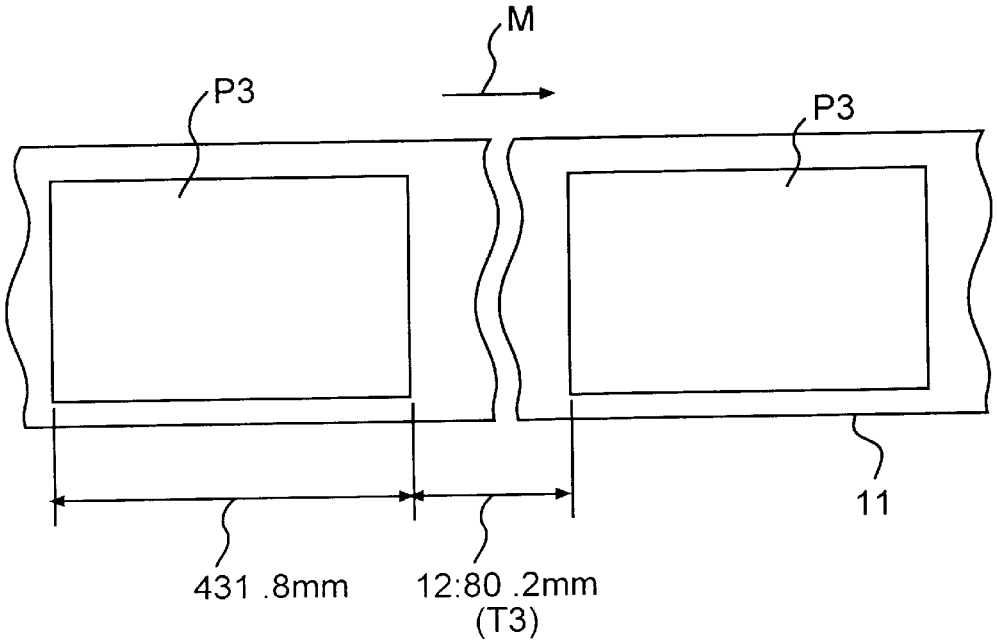
FIG. 4 is a diagram illustrating the positioning of toner images on the transfer belt according to a modification of the present invention.

The operation will be described hereinafter with reference to the case of the formation of an image of greater than letter size, e.g., 17-inch size. FIG. 4 is a diagram illustrating the positioning of a toner image on the transfer belt 11. FIG. 4 shows toner images transferred onto the transfer belt 11 by two cycles. In this diagram, the image P3 is of 17-inch size. The image P3 is disposed in such an arrangement that the long side of the image coincides with the direction of conveyance of the transfer belt 11 (indicated by the arrow M). In this case, a toner image is present on the transfer belt 11 at the same time by one page. The gap I2 between the point at which the toner image P3 has been transferred onto the transfer belt 11 and the point at which the transfer of a toner image of the subsequent color onto the image P3 is initiated is similar to the embodiment described previously and is 80.2 mm by way of example.

Figure 5:
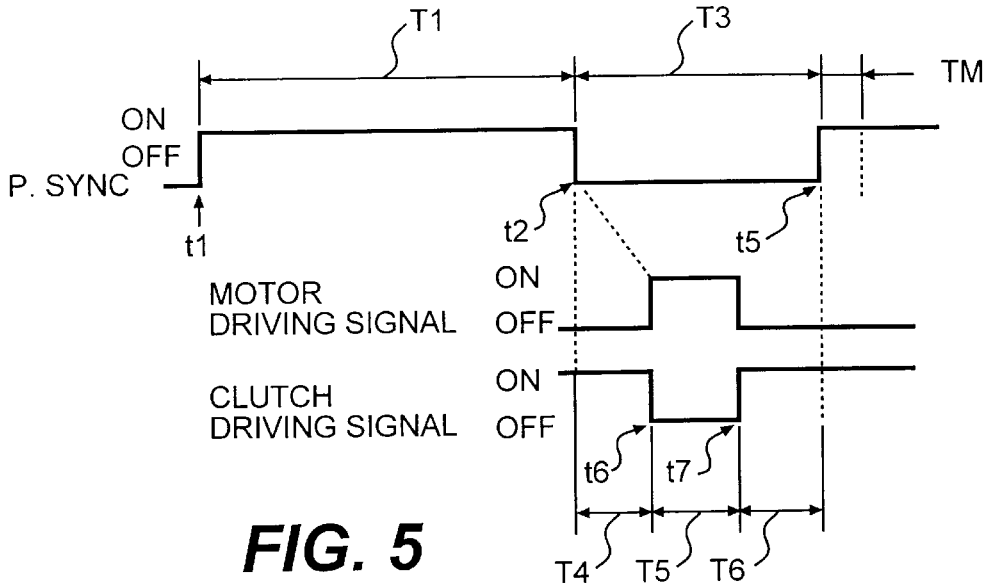
FIG. 5 is a timing chart illustrating the operation of a modification of the image forming apparatus according to the present invention.

FIG. 5 is a timing chart illustrating 17-inch size image formation operation. Like numerals are used where the timing components are the same as those of FIG. 1. In this embodiment, toner images are formed one page by one page. Thus, the page synchronization signal P.SYNC is turned on at the timing t1 and then turned off at the timing t2 to terminate image writing by one page, the page synchronization signal P.SYNC is turned off until the time T3 passes. During this time, the development device 4 is rotated and positioned. At the timing t5, the page synchronization signal P.SYNC is again turned on. During this time, a toner image of the subsequent different color is written on the same page.

Figure 6:
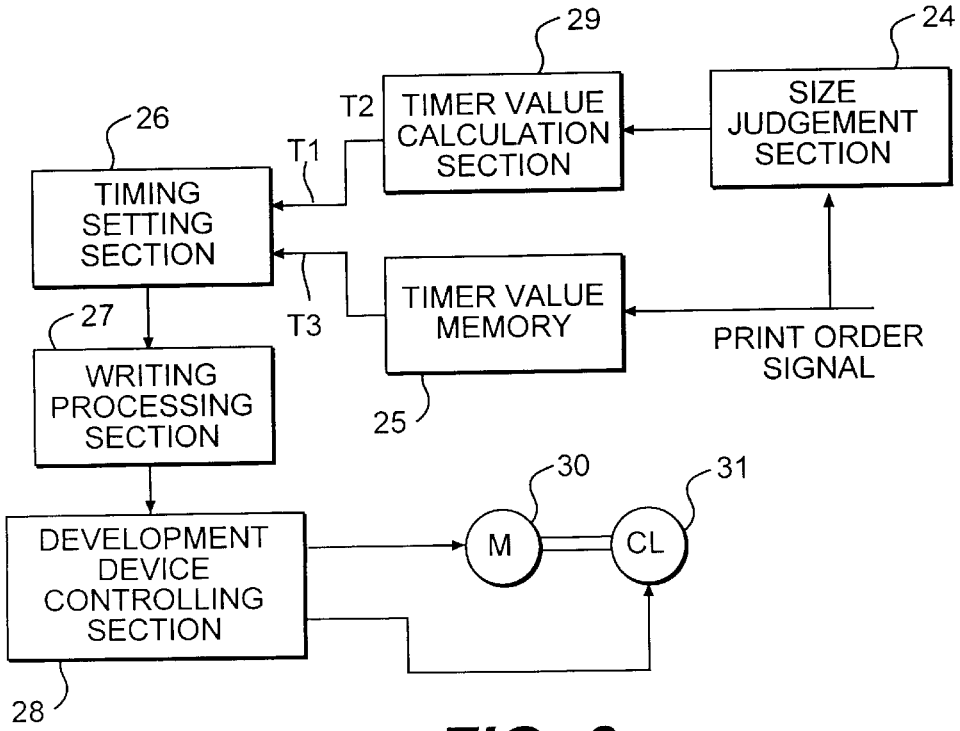
FIG. 6 is a block diagram illustrating the function of an essential part of a controller of the image forming apparatus.

The processing for image formation will be described hereinafter. FIG. 6 is a block diagram illustrating the function of an essential part of a controller for image processing. The controller can be formed by a microcomputer including CPU, RAM, ROM, etc. In the diagram, a size judgement section 24 judges the size of an image to be printed by the image forming apparatus according to a print order signal. The print order signal may be inputted by the operator using an inputting means such as a keyboard or may be inputted from the upper devices through communication interface or the like. The print order signal includes image data representing the content of image and additional data such as size data. The additional data can be retrieved to judge the image size. The print order signal is inputted to the size judgement section 24 as well as to a timer value memory 25. Stored in the timer value memory 25 is the data of the foregoing time T3 calculated from the operation time of the development device 4, the size of the photoreceptor 1, etc. The data of the time T3 is inputted to a timing setting section 26 in response to the print order signal.

On the other hand, the data of the foregoing times T1 and T2 are stored in a timer value calculation section 29. When the size judged by the size judgement section 24 is inputted to the timer value calculation section 29, the data of the times T1 and T2 corresponding to the size are calculated and then inputted to the timing setting section 26. The timer value calculation section 29 can be formed by a table which outputs the times T1 and T2 with the size data as address. For example, in the case of letter size image, the times T1 and T2 are each outputted. In the case of 17-inch size image, one page of image is formed by one cycle. Thus, the time T2 is not required and thus is not outputted.

The timing setting section 26 prepares page synchronization signals according to the foregoing times T1 to T3 and then supplies them to a writing processing section 27. The writing processing section 27 controls the laser scanner 3 according to the foregoing page synchronization signal. At the same time, when the required image writing is terminated, the writing processing section 27 outputs an image termination signal to a development device controlling section 28. The development device controlling section 28 outputs an operation order to a motor 30 for rotating the development device 4 and the solenoid clutch 31 in response to the image termination signal.

Figure 7:
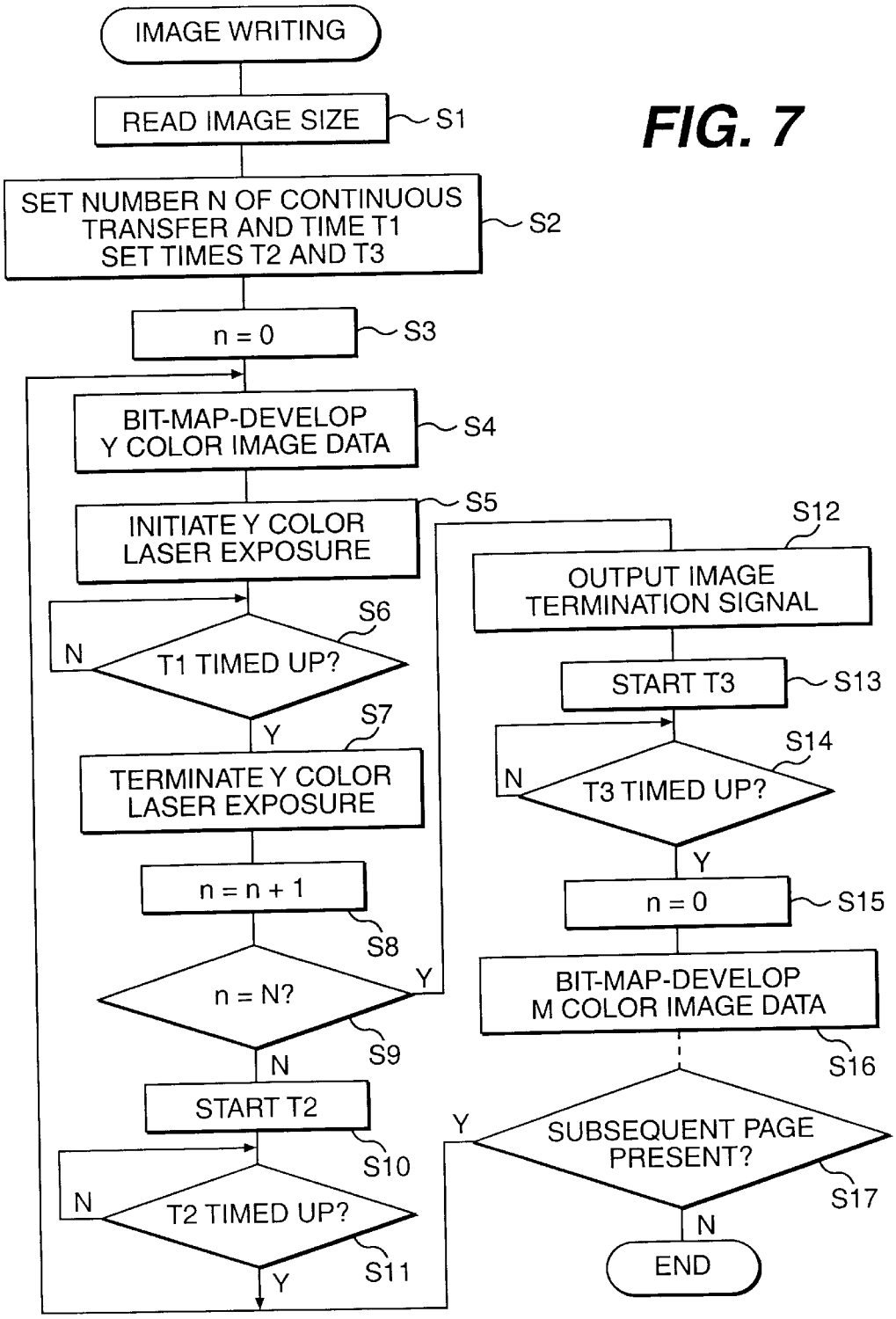
FIG. 7 is a flow chart illustrating the image writing operation.

The foregoing image forming operation will be described in connection with the accompanying flow chart. The following processing is carried out by a microcomputer including CPU, RAM, ROM, etc. FIG. 7 is a flow chart illustrating the operation of image writing. In this flow chart, at step S1, the size of an image to be printed is read. The size of the image can be judged by the additional data contained in the image data inputted. The image size has been detected during the preparation of original or reading of original and then added to the image data.

At step S2, the number N of sheets of toner images of the same color to be continuously transferred and the time T1 are predetermined according to the image size, and the times T2 and T3 are predetermined. The number N of sheets of toner images to be continuously transferred is "2" for letter size or "1" for 17-inch size by way of example. The time T1 is determined on reference to a corresponding table prepared for image size and time T1. The times T2 and T3 are predetermined as fixed data in the ROM, etc. and then read out in the work area. At step S3, the counter n for counting the number of toner images to be transferred onto the transfer belt 11 is set to "0".

At step S4, the image data for Y color on the first page is bit-map-developed in the RAM, etc. At step S5, the image data for Y color is supplied into the laser scanner 3 where laser exposure is then initiated. At the same time, the time T1 is set in a first timer which is then actuated. At step S6, it is judged to see if the first timer is timed up. If so, the operation proceeds to step S7 where laser exposure is terminated. At step S8, the counter n is incremented by +1. At step S9, it is judged to see if the counter n equals to the number N of sheets of toner images to be continuously transferred. In the case of 17-inch size image, this judgement gives an affirmative answer at one pass. If the judgement at step S9 is negative, the operation proceeds to step S10 where the time T2 is set in a second timer which is then actuated. At step S1, it is judged to see if the second timer is timed up. If so, the operation proceeds to step S4 where the subsequent page of toner image of the same color is formed.

If the judgement at step S9 is affirmative, the operation proceeds to step S12 where an image formation termination signal is outputted. This image formation termination signal is a reference for the initiation of the rotation of the development device 4 which will be described later. At step S13, the time T3 is set in a third timer which is then actuated. At step S14, it is judged to see if the second timer is timed up. If so, the operation proceeds to step S15 where the counter n is set to "0". At step S16, the image data for M color on the first page is bit-map-developed in the RAM, etc. Processing is carried out similarly to steps S4 to S13 to effect writing of image data of M color. Similarly, writing of image data of C color and K color is carried out. When this writing is terminated, the operation proceeds to step S17 where it is judged to see if the subsequent page is present. If so, the operation proceeds to step S4. If not, all the processing is terminated.

Figure 8:
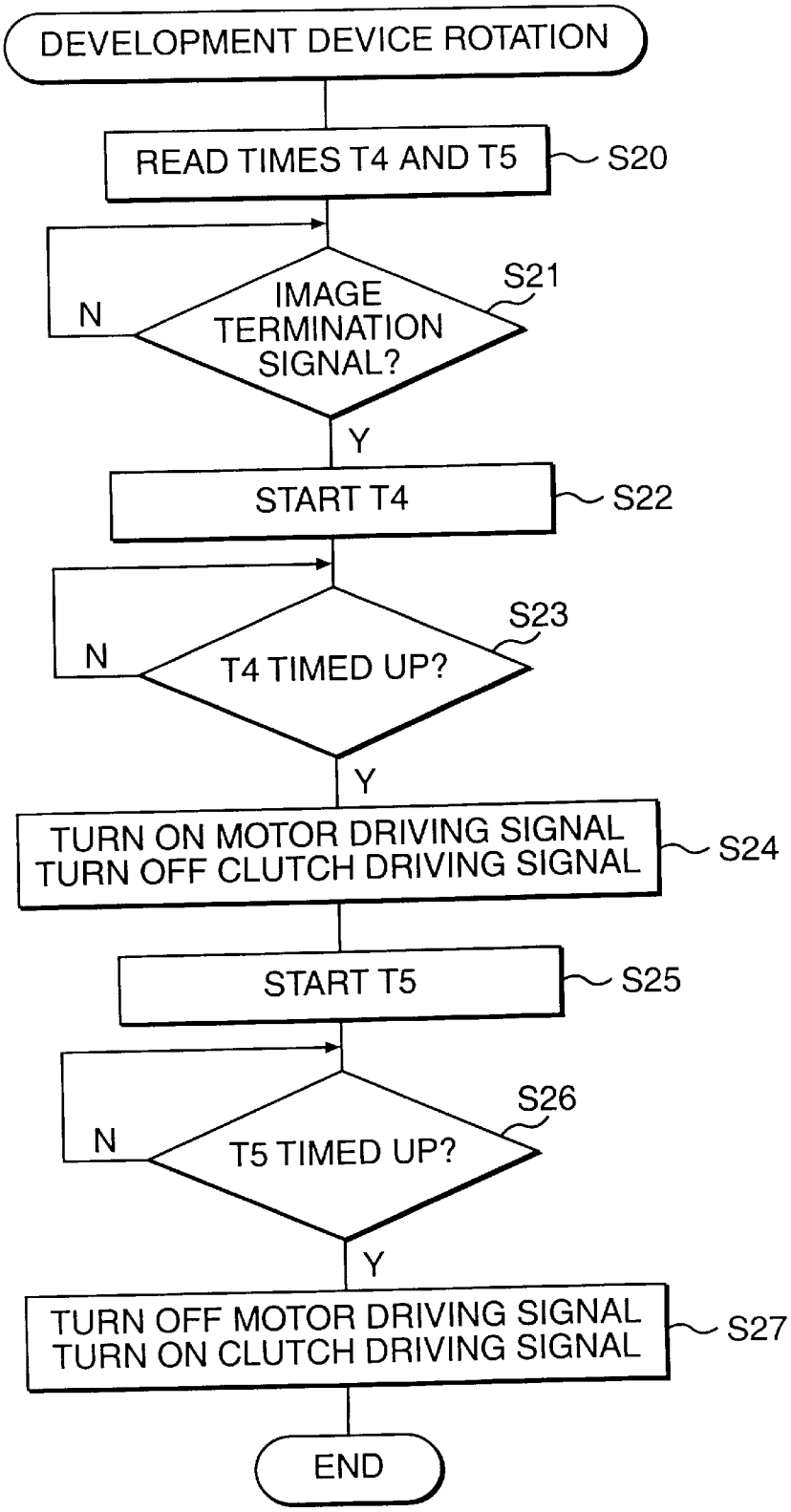
FIG. 8 is a flow chart illustrating the rotary operation of the development device.

The rotary operation of the development device 4 will be described hereinafter. In the flow chart of FIG. 8, at step S20, the times T4 and T5 are read out from the ROM into the work area. At step S21, it is judged to see if the foregoing image formation termination signal is present. If so, the operation proceeds to step S22. At step S22, the time T4 is set in a fourth timer which is then actuated. At step S23, it is judged to see if the fourth timer is timed up. If so, the operation proceeds to step S24. At step S24, the motor driving signal for the development device 4 is turned on while the driving signal for the solenoid clutch 30 is turned off. At step S25, the time T5 is set in a fifth timer which is then actuated. At step S26, it is judged to see if the fifth timer is timed up. If so, the operation proceeds to step S27. At step S27, the motor driving signal for the development device 4 is turned off, and the driving signal for the solenoid clutch 31 is turned on, terminating the processing of this flow chart.

The present embodiment has been described with reference to the case where a laser scanner is used as an exposure means, but the present invention is not limited thereto. For example, the present invention can be applied to an arrangement including an LED exposure device having an LED head array provided opposed to the photoreceptor in which the LED head array is allowed to emit light according to image data.

As described above, in the present invention, image writing by an exposure means is not effected during the operation for movement of development unit in preparation for development. Accordingly, writing is not affected by vibration possibly caused accompanying the movement of the development unit, making it possible to inhibit the generation of banding.

What is claimed is:

1. A multicolor image forming apparatus which transfers a plurality of monochromatic toner images formed on a first image carrier onto a second image carrier in a superimposed manner to form a multicolor toner image, and then transfers the multicolor toner image onto a printing medium, comprising:

exposure means for writing an image based on image data onto the first image carrier;

development means having a plurality of development units provided for each toner color for developing the image written on the first image carrier;

development unit movement means for moving one of a color to be used subsequently among the plurality of development units to a development position; and writing processing means for initiating the writing of an image corresponding to the subsequent toner color by said exposure means after the passage of a first predetermined time required to complete the movement of the preceding development unit by said development unit movement means following the termination of the writing of an image corresponding to the preceding toner color, wherein said writing processing means has an operation mode for repeatedly writing a plurality of pages of image to continuously form toner images of the same color over a plurality of pages on the first image carrier and is arranged to output a writing termination signal when the repeated writing of image is terminated, and said development unit movement means is arranged to move the development unit after the passage of the second time in response to the writing termination signal.

2. The multicolor image forming apparatus according to claim 1, wherein the time passed between pages when the plurality of pages of image are repeatedly written is predetermined shorter than the first time.

3. A multicolor image forming apparatus which transfers a plurality of monochromatic toner images formed on a first image carrier onto a second image carrier in a superimposed manner to form a multicolor toner image, and then transfers the multicolor toner image onto a printing medium comprising:

exposure means for writing an image based on image data onto the first image carrier;

development means having a plurality of development units provided for each toner color for developing the image written on the first image carrier;

development unit movement means for moving one for a color to be used subsequently among the plurality of development units to a development position; and writing processing means for initiating the writing of an image corresponding to the subsequent toner color by said exposure means after the passage of a first predetermined time required to complete the movement of the preceding development unit by said development unit movement means following the termination of the writing of an image corresponding to the preceding toner color, wherein the first predetermined time includes a second time between the point at which the writing of an image corresponding to the preceding toner color is terminated and the point at which the development of said image is terminated, a third time required to move the development unit, and a fourth time required until vibration accompanying the movement of the development unit ends after the stoppage of said development unit movement means.

4. The multicolor image forming apparatus according to either of claims 1 or 3, wherein the plurality of development units are disposed on the same radius from a center of rotation, and said development unit movement means includes driving means for rotating the development units by a predetermined angle about the center of rotation.

5. The multicolor image forming apparatus according to either of claims 1 or 3, wherein each of the development units includes a development roll and gap holding means for keeping a gap between the development roll and the surface of the first image carrier constant.

6. The multicolor image forming apparatus according to claim 3, wherein said writing processing means has an operation mode for repeatedly writing a plurality of pages of image to continuously form toner images of the same color over a plurality of pages on the first image carrier and is arranged to output a writing termination signal when the repeated writing of image is terminated, and said development unit movement means is arranged to move the development unit after the passage of the second time in response to the writing termination signal.

7. The multicolor image forming apparatus according to claim 6, wherein the plurality of development units are disposed on the same radius from a center of rotation, and said development unit movement means includes driving means for rotating the development units by a predetermined angle about the center of rotation.

8. The multicolor image forming apparatus according to claim 6, wherein each of the development units includes a development roll and gap holding means for keeping a gap between the development roll and the surface of the first image carrier constant.

* * * * *